US005630848A

United States Patent [19]

Young et al.

[11] Patent Number: 5,630,848

[45] Date of Patent: *May 20, 1997

[54] DRY CLEANING PROCESS WITH HYDROENTANGLED CARRIER SUBSTRATE

[75] Inventors: Terrill A. Young; Jane L. Bavely, both of Cincinnati; Timothy C. Roetker, Fairfield; Maxwell G. Davis, Forest Park, all of Ohio

[73] Assignee: The Procter & Gamble Company, Cincinnati, Ohio

[ * ] Notice: The term of this patent shall not extend beyond the expiration date of Pat. No. 5,547,476.

[21] Appl. No.: 544,354

[22] Filed: Oct. 17, 1995

Related U.S. Application Data

[63] Continuation-in-part of Ser. No. 450,459, May 25, 1995, abandoned.

[51] Int. Cl.[6] ..... D06L 1/04; C11D 3/37; C11D 3/43; C11D 7/50

[52] U.S. Cl. ..... 8/137; 8/142; 510/281; 510/284; 510/291; 510/295; 510/341; 510/342; 510/350; 510/351; 510/356; 510/357; 510/361; 510/426; 510/427; 510/433; 510/434; 510/476; 510/505; 510/506

[58] Field of Search ..... 8/90, 91, 8.6, 8.8, 8/8.9, 142, 224, 288, 137, 290; 510/291, 295, 281, 284, 342, 361, 434, 476, 505, 506

[56] References Cited

U.S. PATENT DOCUMENTS

| | | | |
|---|---|---|---|
| 1,747,324 | 2/1930 | Savitt . | |
| 2,679,482 | 5/1954 | Ross | 252/138 |
| 3,432,253 | 3/1969 | Dixon et al. | 8/142 |
| 3,591,510 | 7/1971 | Zenk | 252/137 |
| 3,593,544 | 7/1971 | Henderson | 68/12 |
| 3,647,354 | 3/1972 | Loeb | 8/158 |
| 3,705,113 | 12/1972 | Sharman | 252/555 |
| 3,737,387 | 6/1973 | Marple | 252/170 |
| 3,764,544 | 10/1973 | Haworth | 252/170 |
| 3,766,062 | 10/1973 | Wixon | 252/8.7 |
| 3,770,373 | 11/1973 | Schwartz | 8/142 |
| 3,882,038 | 5/1975 | Clayton et al. | 252/164 |
| 3,907,496 | 9/1975 | Néel et al. | 8/142 |
| 3,949,137 | 4/1976 | Akrongold | 428/311 |
| 3,956,198 | 5/1976 | Bauer | 252/542 |
| 3,956,556 | 5/1976 | McQueary | 428/131 |
| 4,007,300 | 2/1977 | McQueary | 427/242 |
| 4,063,961 | 12/1977 | Howard et al. | 134/4 |
| 4,097,397 | 6/1978 | Mizutani et al. | 252/153 |
| 4,102,824 | 7/1978 | Mizutani et al. | 252/545 |
| 4,115,061 | 9/1978 | Grünewälder | 8/137 |
| 4,126,563 | 11/1978 | Barker | 252/8.8 |
| 4,130,392 | 12/1978 | Diehl et al. | 8/101 |
| 4,139,475 | 2/1979 | Schwadtke et al. | 252/8.6 |
| 4,170,678 | 10/1979 | Urfer et al. | 428/124 |
| 4,188,447 | 2/1980 | Ehlenz | 428/310 |
| 4,219,333 | 8/1980 | Harris | 8/137 |
| 4,336,024 | 6/1982 | Denissenko et al. | 8/142 |
| 4,395,261 | 7/1983 | Lutz | 8/111 |
| 4,396,521 | 8/1983 | Borrello | 252/118 |
| 4,493,781 | 1/1985 | Chapman et al. | 252/88 |
| 4,606,842 | 8/1986 | Keyes et al. | 252/174.23 |
| 4,659,494 | 4/1987 | Soldanski et al. | 252/88 |
| 4,659,496 | 4/1987 | Klemm et al. | 252/90 |
| 4,666,621 | 5/1987 | Clark et al. | 252/91 |
| 4,692,277 | 9/1987 | Siklosi | 252/558 |
| 4,758,641 | 7/1988 | Hsu | 526/208 |
| 4,797,221 | 1/1989 | Gueldenzopf | 252/95 |
| 4,797,310 | 1/1989 | Barby et al. | 428/71 |
| 4,802,997 | 2/1989 | Fox et al. | 252/8.6 |
| 4,806,254 | 2/1989 | Church | 252/8.6 |
| 4,834,900 | 5/1989 | Soldanski et al. | 252/88 |
| 4,847,089 | 7/1989 | Kramer et al. | 424/405 |
| 4,849,257 | 7/1989 | Borcher et al. | 427/242 |
| 4,882,917 | 11/1989 | Mizusawa et al. | 68/17 A |
| 4,886,615 | 12/1989 | Dehan | 252/90 |
| 4,909,962 | 3/1990 | Clark | 252/547 |
| 4,938,879 | 7/1990 | Kellett | 252/8.75 |
| 4,943,392 | 7/1990 | Hastedt et al. | 252/539 |
| 4,946,617 | 8/1990 | Sheridan et al. | 252/91 |
| 4,966,724 | 10/1990 | Culshaw et al. | 252/158 |
| 4,983,317 | 1/1991 | Requejo et al. | 252/174.24 |
| 5,004,557 | 4/1991 | Nagarajan et al. | 252/174.24 |
| 5,009,747 | 4/1991 | Viazmensky et al. | 162/115 |
| 5,015,513 | 5/1991 | Newbold et al. | 428/35.5 |
| 5,035,826 | 7/1991 | Durbut et al. | 252/121 |

(List continued on next page.)

FOREIGN PATENT DOCUMENTS

| | | | |
|---|---|---|---|
| 1005204 | 2/1977 | Canada | 8/93.11 |
| 1295912 | 2/1992 | Canada | C11D 1/72 |
| 0208989 | 1/1987 | European Pat. Off. | D06L 1/00 |
| 0213500 | 3/1987 | European Pat. Off. | C11D 17/00 |
| 0232530 | 8/1987 | European Pat. Off. | C11D 3/43 |
| 0261718 | 3/1988 | European Pat. Off. | C11D 17/00 |
| 261874 | 3/1988 | European Pat. Off. | C11D 3/43 |
| 286167 | 10/1988 | European Pat. Off. | C11D 3/20 |
| 0329209 | 8/1989 | European Pat. Off. | C11D 3/43 |
| 0334463 | 9/1989 | European Pat. Off. | C11D 3/44 |

(List continued on next page.)

OTHER PUBLICATIONS

Hunt, D.G. and N.H. Morris "PnB and DPnB Glycol Ethers", *HAPPI*, Apr. 1989, pp. 78–82.

Trautwein, K., J. Nassal, Ch. Kopp & L. Karle, "The Disinfectant Action of Glycols on Tuberculosis Organisms and Their Practical Application", *Monatsh. Tierheilk*, vol. 7, Suppl. (1955) pp. 171–187. (Abstract only).

(List continued on next page.)

*Primary Examiner*—Paul Lieberman
*Assistant Examiner*—Lorna M. Douyon
*Attorney, Agent, or Firm*—Jerry J. Yetter; Jacobus C. Rasser

[57] ABSTRACT

A home dry cleaning article is provided. Thus, a hydroentangled carrier sheet comprising mixed cellulosic, rayon, polyester and optional bicomponent fibers which is releasably impregnated with solvents such as butoxy propoxy propanol, 1,2-octanediol as a wetting agent, water and an emulsifier is prepared. The article is placed in a plastic bag with soiled garments and tumbled in a hot-air clothes dryer. The garments are cleaned and refreshed.

8 Claims, No Drawings

U.S. PATENT DOCUMENTS

| | | | |
|---|---|---|---|
| 5,041,230 | 8/1991 | Borcher et al. | 252/8.9 |
| 5,051,212 | 9/1991 | Culshaw et al. | 252/546 |
| 5,061,393 | 10/1991 | Linares et al. . | |
| 5,062,973 | 11/1991 | Kellett | 252/8.75 |
| 5,066,413 | 11/1991 | Kellett | 252/8.75 |
| 5,080,822 | 1/1992 | VanEenam | 252/170 |
| 5,091,102 | 2/1992 | Sheridan | 252/91 |
| 5,094,770 | 3/1992 | Sheridan et al. | 252/91 |
| 5,102,573 | 4/1992 | Han et al. | 252/153 |
| 5,108,643 | 4/1992 | Loth et al. | 252/174.11 |
| 5,108,660 | 4/1992 | Michael | 252/545 |
| 5,112,358 | 5/1992 | Deal | 8/137 |
| 5,133,967 | 7/1992 | Smith | 424/401 |
| 5,145,523 | 9/1992 | Halpin | 106/287.24 |
| 5,173,200 | 12/1992 | Kellett | 252/8.8 |
| 5,202,045 | 4/1993 | Karpusiewicz et al. | 252/90 |
| 5,213,624 | 5/1993 | Williams | 134/40 |
| 5,232,632 | 8/1993 | Woo et al. | 252/546 |
| 5,236,710 | 8/1993 | Guerrero et al. | 424/401 |
| 5,238,587 | 8/1993 | Smith et al. | 252/8.6 |
| 5,286,400 | 2/1994 | Paszek et al. | 252/88 |
| 5,304,334 | 4/1994 | Lahanas et al | 252/314 |
| 5,322,689 | 6/1994 | Hughes et al. | 424/401 |
| 5,336,445 | 8/1994 | Michael et al. | 252/548 |
| 5,336,497 | 8/1994 | Guerrero et al. | 424/401 |
| 5,342,549 | 8/1994 | Michael | 252/546 |
| 5,344,643 | 9/1994 | Thiel et al. | 424/70 |
| 5,350,541 | 9/1994 | Michael et al. | 252/548 |
| 5,362,422 | 11/1994 | Masters | 252/544 |
| 5,380,528 | 1/1995 | Alban et al. | 424/401 |
| 5,415,812 | 5/1995 | Durbut et al. | 252/547 |

FOREIGN PATENT DOCUMENTS

| | | | |
|---|---|---|---|
| 0347110 | 12/1989 | European Pat. Off. | C11D 1/83 |
| 0429172A1 | 5/1991 | European Pat. Off. | D06F 43/00 |
| 0491531 | 6/1992 | European Pat. Off. . | |
| 503219 | 9/1992 | European Pat. Off. | C11D 3/30 |
| 0513948 | 11/1992 | European Pat. Off. | C11D 7/32 |
| 595383 | 5/1994 | European Pat. Off. | C11D 1/92 |
| 2021561 | 11/1970 | Germany . | |
| 2460239 | 7/1975 | Germany | C11D 17/04 |
| 3904610 | 8/1990 | Germany . | |
| 4007362 | 9/1991 | Germany | D06F 58/00 |
| 4129986 | 11/1993 | Germany | A61K 7/48 |
| 53-058095 | 5/1978 | Japan . | |
| 61-014298 | 1/1986 | Japan . | |
| 61-085498 | 5/1986 | Japan | C11D 10/02 |
| 62-252499 | 11/1987 | Japan | C11D 3/60 |
| 63-051500 | 3/1988 | Japan | C11D 3/60 |
| 02206695 | 8/1990 | Japan | C11D 1/68 |
| 05171566 | 7/1993 | Japan | D06L 1/04 |
| 06049498 | 2/1994 | Japan | C11D 7/60 |
| 06/049497 | 2/1994 | Japan | C11D 7/60 |
| 06146041 | 5/1994 | Japan | C23G 5/032 |
| 1397475 | 6/1975 | United Kingdom | C11D 10/02 |
| 1598911 | 9/1981 | United Kingdom | D06F 43/00 |
| WO91/09104 | 6/1991 | WIPO | C11D 7/32 |
| WO91/11505 | 8/1991 | WIPO | C11D 1/90 |
| WO91/13145 | 9/1991 | WIPO | C11D 7/50 |
| WO92/19713 | 11/1992 | WIPO | C11D 17/00 |
| WO93/04151 | 3/1993 | WIPO | C11D 1/83 |
| WO93/06204 | 4/1993 | WIPO | C11D 7/50 |
| WO93/25654 | 12/1993 | WIPO | C11D 7/50 |
| WO94/05766 | 3/1994 | WIPO | C11D 7/50 |
| WO94/09108 | 4/1994 | WIPO | C11D 10/04 |

OTHER PUBLICATIONS

Ilg, H., & H. Fischer, "Synthesis and Application of Propoxylized Alcohols", *Text–Prax.*, vol. 25, No. 8, (1970), pp. 484–487 (Abstract only).

Komarova, L.F., U. N. Garber & L. G. Chub, "Physical Properties of Monoethers of Mono— and Diglycols", *Zh. Obshch. Khim.*, vol. 40, No. 11 (1970), p. 2534, Russian (Abstract only).

Sokolowski, A. & J. Chlebicki, "The Effect of Polyoxypropylene Chain Length in Nonionic Surfactants on Their Adsorption at the Aqueous Solution–Air Interface", *Tenside Deterg.*, vol. 19, No. 5 (1982), pp. 282–286 (Abstract only).

Hamlin, J. E., "Propylene Glycol Ethers and Esters in Solvent–Based Paint System", *Congr. FATIPEC*, 17th (4), (1984), pp. 107–122 (Abstract only).

DeFusco, A.J., "Coalescing Solvents for Architectural and Industrial Waterborne Coatings", *Proc. Water–Borne Higher–Solids Coat. Symp.*, 15th, (1988), pp. 297–330 (Abstract only).

Vance, R.G., N.H. Morris & C. M. Olson, "Coupling Solvent Effects on Water–Reducible Alkyd Resins", *Proc. Water–Born Higher–Solids Coat. Symp.*, 16th (1989), pp. 269–282 (Abstract only).

Szymanowski, J., "The Estimation of Some Properties of Surface Active Agents", *Tenside, Surfactants, Deterg.*, vol. 27, No. 6 (1990), pp. 386–392 (Abstract only).

Spauwen, J., R. Ziegler & J. Zwinselman, "New Polypropylene Glycol–based Solvents for Aqueous Coating Systems", *Spec. Publ. –R. Soc. Chem.* 76 (Addit. Water–Based Coat.), (1990) (Abstract only).

Sokolowski, A., "Chemical Structure and Thermodynamics of Amphiphile Solutions. 2. Effective Length of Alkyl Chain in Oligooxyalkylenated Alcohols", *Colloids Surf.*, vol. 56 (1991), pp. 239–249 (Abstract only).

Asgharian, N., P. Otken, C. Sunwoo & W. H. Wade, "Synthesis and Performance of High–Efficiency Cosurfactants. 1. Model Systems", *Langmuir*, vol. 7, No. 12 (1991), pp. 2904–2910. (Abstract only).

DRY CLEANING PROCESS WITH HYDROENTANGLED CARRIER SUBSTRATE

CROSS-REFERENCE TO RELATED APPLICATION

This is a continuation-in-part of application Ser. No. 08/450,459, filed May 25, 1995, now abandoned.

FIELD OF THE INVENTION

The present invention relates to dry cleaning processes and compositions which are especially adapted for use in the home.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments.

While solvent-based dry cleaning processes are quite effective for removing oily soils and stains, they are not optimal for removing particulates such as clay soils, and may require special treatment conditions to remove proteinaceous stains. Ideally, particulates and proteinaceous stains are removed from fabrics using detersive ingredients and operating conditions which are more akin to aqueous laundering processes than to conventional dry cleaning.

In addition to the cleaning function, dry cleaning also provides important "refreshment" benefits. For example, dry cleaning removes undesirable odors and extraneous matter such as hair and lint from garments, which are then generally folded or pressed to remove wrinkles and restore their original shape. Of course, such refreshment benefits are also afforded by aqueous laundering processes.

As can be seen from the foregoing, and aside from the effects on certain fabrics such as woolens, there are no special, inherent advantages for solvent-based immersion dry cleaning over aqueous cleaning processes with respect to fabric cleaning or refreshment. Moreover, on a per-garment basis, commercial dry cleaning is much more expensive than aqueous cleaning processes.

While it would be of considerable benefit to consumers to provide dry cleaning compositions and processes which can be used in the home, the solvent systems used in commercial dry cleaning render this impractical. Indeed, various in-home dry cleaning systems have been suggested, but have not been widely accepted. Typically, such in-home systems comprise a carrier substrate which is releasably impregnated with a cleaning composition. The cleaning composition is carried by the substrate and is brought in contact with soiled fabrics, preferably in a hot air clothes dryer, to effect cleaning. In general, attempts to improve such dry cleaning processes involve the design of new apparatus, the selection of new cleaning solvents, or the formulation of new dry cleaning compositions. While such attempts may prove effective, they can lead to expensive and unduly complicated formulations and processes for the home user. Surprisingly, no substantial effort seems to have been expended in determining whether the carrier substrate, itself, could significantly improve overall cleaning performance.

The present invention provides a new approach to the problem of improving in-home dry cleaning and spot removal processes. It has now been discovered that certain types of carrier substrates, when used in the manner disclosed herein, themselves improve cleaning performance, especially in an in-home dry cleaning operation. Accordingly, it is an object of the present invention to provide an optimal carrier for dry cleaning and spot removal processes. It is another objective herein to provide a combination of said preferred carrier with a preferred cleaning composition, all adapted for use in an in-home, non-immersion dry cleaning and spot removal operation. These and other objects are secured herein, as will be seen from the following disclosures.

BACKGROUND ART

Dry cleaning processes are disclosed in: EP 429,172A1, published 29.05.91, Leigh, et al.; and in U.S. Pat. No. 5,238,587, issued Aug. 24, 1993, Smith, et al. Other references relating to dry cleaning compositions and processes, as well as wrinkle treatments for fabrics, include: GB 1,598,911; and U.S. Pat. Nos. 4,126,563, 3,949,137, 3,593,544, 3,647,354; 3,432,253 and 1,747,324; and German applications 2,021,561 and 2,460,239, 0,208,989 and 4,007,362. Cleaning/pre-spotting compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. Sheet substrates for use in a laundry dryer are disclosed in Canadian 1,005,204. U.S. Pat. Nos. 3,956,556 and 4,007,300 relate to perforated sheets for fabric conditioning in a clothes dryer. U.S. Pat. No. 4,692,277 discloses the use of 1,2-octanediol in liquid cleaners.

SUMMARY OF THE INVENTION

The present invention encompasses an article for cleaning and refreshing fabrics, comprising:

(A) a preferred hydroentangled carrier substrate, especially hydroentangled substrates comprising a mixture of synthetic and natural types of fibers, as disclosed more fully hereinafter, said carrier substrate releasably containing;

(B) a cleaning composition, most preferably comprising:
- (i) water;
- (ii) an etherified propanol solvent, especially "BPP" solvent, as disclosed hereinafter;
- (iii) optionally, 1,2-octanediol;
- (iv) an emulsifier, especially a polyacrylate emulsifier as disclosed hereinafter;
- (v) optionally, a detersive surfactant; and
- (vi) optionally, but preferably, a perfume, and other minor ingredients.

The dry-cleaning process herein is preferably conducted by placing said fabrics together with the carrier-plus-cleaning composition in a container, such as a flexible bag, closing said container and agitating said container. In a convenient mode, the process is conducted by agitating the container in a tumbling apparatus, such as a hot air clothes dryer or a washing machine having a horizontally mounted rotatable drum. Heat is preferably employed during the agitation. In one mode, the carrier is allowed to move freely and co-mingle with the fabrics being cleaned. In another mode, the carrier is affixed to an inner wall of the container.

A preferred and convenient process herein comprises the steps of:

(a) placing said fabrics to be cleaned and said carrier-plus-cleaning composition as noted above within a container comprising a flexible plastic bag;

(b) closing and sealing said bag;

(c) placing said bag in a rotating apparatus; especially a hot air clothes dryer, and wherein the process is conducted at an air temperature within said dryer of at least about 50° C.;

(d) rotating said bag for a period of at least about 10 minutes; and (e) removing said fabrics from the bag.

All percentages, ratios and proportions herein are by weight, unless otherwise specified. All documents cited are, in relevant part, incorporated herein by reference.

DETAILED DESCRIPTION OF THE INVENTION

The carrier and the ingredients of the dry cleaning compositions and their use in the process of the present invention are described seriatim hereinafter.

Carder—The special, improved carrier used herein is preferably in integral form, i.e., in the form of a sheet having the specifications disclosed hereinafter. (Comminuted carrier pieces may also be used, but are not preferred, since they are difficult to retrieve from the fabrics after the cleaning process is completed.) Surprisingly this carrier is not merely a passive absorbent for the cleaning compositions herein, but actually optimizes cleaning performance. While not intending to be limited by theory, it may be speculated that the carrier is more effective in delivering the cleaning composition to soiled fabrics. Or, this particular carrier might be better for removing soils by contact with the soiled fabrics, due to its mixture of fibers. Whatever the reason, improved dry cleaning performance is secured in the practice of the present invention.

The preferred carrier herein comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244. The manufacture of such materials forms no part of this invention and is already disclosed in the literature. See, for example, U.S. Pat. Nos. 5,009,747, Viazmensky, et al., Apr. 23, 1991 and 5,292,581, Viazmensky, et al., Mar. 8, 1994, incorporated herein by reference. Preferred materials for use herein have the following physical properties.

| | Grade 10244 | Targets | Optional Range |
|---|---|---|---|
| Basis Weight | $gm/m^2$ | 55 | 35–75 |
| Thickness | microns | 355 | 100–1500 |
| Density | gm/cc | 0.155 | 0.1–0.25 |
| Dry Tensile | gm/25 mm | | |
| MD | | 1700 | 400–2500 |
| CD | | 650 | 100–500 |
| Wet Tensile | gm/25 mm | | |
| MD* | | 700 | 200–1250 |
| CD* | | 300 | 100–500 |
| Brightness | % | 80 | 60–90 |

-continued

| | Grade 10244 | Targets | Optional Range |
|---|---|---|---|
| Absorption Capacity | % | 735 | 400–900 ($H_2O$) |
| Dry Mullen | $gm/cm^2$ | 1050 | 700–1200 |

*MD — machine direction; CD — cross direction

As disclosed in U.S. Pat. Nos. 5,009,747 and 5,292,281, the hydroentangling process provides a nonwoven material which comprises cellulosic fibers, and preferably at least about 5% by weight of synthetic fibers, and requires less than 2% wet strength agent to achieve improved wet strength and wet toughness.

In addition to the improved cleaning performance, it has now been discovered that the hydroentangled carrier material used herein provides an additional, unexpected benefit due to its resiliency. In-use, the dry cleaning sheets herein are designed to function in a substantially open configuration. However, the sheets are packaged and sold to the consumer in a folded configuration. It has been discovered that carrier sheets made from conventional materials tend to undesirably revert to their folded configuration in-use. This undesirable attribute can be overcome by perforating such sheet, but this requires an additional processing step. It has now been discovered that the hydroentangled materials used to form the carrier sheet herein do not tend to re-fold during use, and thus do not require such perforations (although, of course, perforations may be used, if desired). Accordingly, this newly-discovered and unexpected attribute of the carrier materials herein makes them optimal for use in the manner of the present invention.

In addition to the foregoing considerations, the carrier herein is safe and effective under the intended operating conditions of the present process. The carrier is not flammable during the process, nor does it deleteriously interact with the cleaning composition or with the fabrics being cleaned. The carrier is non-linting. By "non-linting" is meant that the carrier resists the shedding of visible fibers or microfibers onto the fabrics being cleaned, i.e., the deposition of what is known in common parlance as "lint". The carrier can easily and adequately be judged for its acceptability with respect to lint-resistance by rubbing it on a piece of dark blue woolen cloth and visually inspecting the cloth for lint residues.

The carrier herein is of a size which provides sufficient surface area that effective contact between the surface of the carrier and the surface of the fabrics being cleaned is achieved. Of course, the size of the carrier should not be so large as to be unhandy for the user. Typically, the dimensions of the carrier will be sufficient to provide a macroscopic surface area (both sides of the carrier) of at least about 360 $cm^2$, preferably in the range from about 360 $cm^2$ to about 3000 $cm^2$. For example, a rectangular carrier may have the dimensions (x-direction) of from about 20 cm to about 35 cm, and (y-direction) of from about 18 cm to about 45 cm. Such matters as density and caliper of the sheet can be varied, depending on the amount of cleaning composition the formulator wishes to apply.

The carrier releasably contains the cleaning composition. By "releasably contains" means that the cleaning composition is effectively released from the carrier onto the soiled fabrics as part of the dry cleaning process herein.

Cleaning Compositions—The chemical compositions which are used to provide the cleaning function in the present dry cleaning process comprise ingredients which are safe and effective for their intended use. Since the process herein does not involve an aqueous rinse step, the cleaning compositions employ ingredients which do not leave undesirable residues on fabrics when employed in the manner disclosed herein. Moreover, since the process may be carried out in a hot air clothes dryer, the compositions contain only ingredients whose flash points render them safe for such use. The cleaning compositions preferably do contain some water, since water not only aids in the cleaning function, but also can help remove wrinkles and restore fabric drape and appearance, especially in hot air dryers. While conventional laundry detergents are typically formulated to provide good cleaning on cotton and cotton/polyester blend fabrics, the cleaning compositions herein must be formulated to safely and effectively clean and refresh fabrics such as wool, silk, rayon, rayon acetate, and the like.

In addition, the cleaning compositions herein comprise ingredients which are specially selected and formulated to minimize dye removal from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred cleaning compositions herein are formulated to minimize or avoid this problem.

The dye removal attributes of the present cleaning compositions can be compared with art-disclosed cleaners using photographic or photometric measurements, or by means of a simple, but effective, visual grading test. Numerical score units can be assigned to assist in visual grading and to allow for statistical treatment of the data, if desired. Thus, in one such test, a colored garment (typically, silk, which tends to be more susceptible to dye loss than most woolen or nylon substrates) is treated by padding-on cleaner using an absorbent, white paper hand towel. Hand pressure is applied, and the amount of dye which is transferred onto the white towel is assessed visually. Numerical units ranging from: (1) "I think I see a little dye on the towel"; (2) "I know I see some dye on the towel"; (3) "I see a lot of dye on the towel"; through (4) "I know I see quite a lot of dye on the towel" are assigned by panelists.

Having due regard to the foregoing considerations, the following illustrates the ingredients used in the cleaning compositions herein, but is not intended to be limiting thereof.

(a) Water—The compositions will comprise at least about 60%, typically from about 80% to about 95%, by weight, of water. Stated otherwise, the objective is to provide at least about 6 g of water per kg of fabrics being cleaned.

(b) Solvent—The compositions will comprise at least about 4%, typically from about 5% to about 25%, by weight, of organic solvent. The objective is to provide at least about 0.4 g, preferably from about 0.5 g to about 2.5 g, of solvent per kg of fabrics being cleaned.

(c) 1,2-octanediol (OD)—The composition herein will optionally comprise at least about 0.1%, preferably from about 0.5% to about 10%, by weight, of the OD. Stated otherwise, the objective is to provide from about 0.01 g to about 3 g of OD per kg of fabrics being cleaned.

(d) Emulsifier—The compositions will comprise sufficient emulsifier to provide a stable, homogeneous composition comprising components (a), (b) and (c). For the preferred emulsifiers disclosed hereinafter, levels as low as 0.05%, preferably 0.07% to about 0.20%, by weight, are quite satisfactory.

(d) Optionals—The compositions herein may comprise various optional ingredients, including perfumes, conventional surfactants, carriers and the like. If used, such optional ingredients will typically comprise from about 0.1% to about 10%, by weight, of the compositions, having due regard for residues on the cleaned fabrics.

The preferred solvent herein is butoxy propoxy propanol (BPP) which is available in commercial quantities as a mixture of isomers in about equal amounts. The isomers, and mixtures thereof, are all useful herein. The isomer structures are as follows:

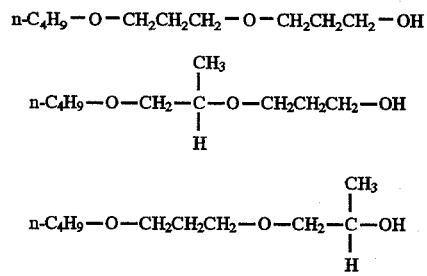

BPP is outstanding for cleaning, and is so effective that it allows the amount of the relatively expensive 1,2-octanediol to be minimized. Moreover, it allows for the formulation of effective cleaning compositions herein without the use of conventional surfactants. Importantly, the odor of BPP is of a degree and character that it can be relatively easily masked by conventional perfume ingredients. While BPP is not completely miscible with water and, hence, could negatively impact processing of the cleaning compositions herein, that potential problem has been successfully overcome by means of the PEMULEN-type polyacrylate emulsifiers, as disclosed hereinafter.

It has now been determined that 1,2-octanediol ("OD") affords special advantages in the formulation of the cleaning compositions herein. From the standpoint of aesthetics, OD is a relatively innocuous and low odor material. Moreover, OD appears to volatilize from fabric surfaces without leaving visible residues. This is especially important in a dry cleaning process of the present type which is conducted without a rinse step. From the performance standpoint, OD appears to function both as a solvent for greasy/oily stains and as what might be termed a "pseudo-surfactant" for particulate soils and water-soluble stains. Whatever the physical-chemical reason, OD has now been found to be a superior wetting agent with respect to both cleaning and ease-of-use in the present context of home-use cleaning compositions and processes.

The BPP solvent used herein is preferably a mixture of the aforesaid isomers. In a preferred mode, the cleaning compositions comprise a mixture of the 1,2-octanediol and BPP, at a weight ratio of OD:BPP in the range of from about 1:250 to about 2:1, preferably from about 1:200 to about 1:5.

The highly preferred emulsifier herein is commercially available under the trademark PEMULEN, The B. F. Goodrich Company, and is described in U.S. Pat. Nos. 4,758,641 and 5,004,557, incorporated herein by reference. PEMULEN polymeric emulsifiers are high molecular weight polyacrylic acid polymers. The structure of PEMULEN includes a small portion that is oil-loving (lipophilic) and a large water-loving (hydrophilic) portion. The structure allows PEMULEN to function as a primary oil-in-water emulsifier. The lipophilic portion adsorbs at the oil-water interface, and the hydrophilic portion swells in the water forming a network around the oil droplets to provide emulsion stability. An important advantage for the use of such polyacrylate emulsifiers herein is that cleaning compositions can be prepared which contain solvents or levels of solvents that are otherwise not soluble or readily miscible with water. A further advantage is that effective emulsification can be accomplished using PEMULEN-type emulsifier at extremely low usage levels (0.05–0.2%), thereby minimizing the level of any residue left on fabrics following product usage. For comparison, typically about 3–7% of conventional anionic or nonionic surfactants are required to stabilize oil-in-water emulsions, which increases the likelihood that a residue will be left on the fabrics. Another advantage is that emulsification (processing) can be accomplished effectively at room temperature.

While the cleaning compositions herein function quite well with only the 1,2-octanediol, BPP, PEMULEN and water, they may also optionally contain detersive surfactants to further enhance their cleaning performance. While a wide variety of detersive surfactants such as the $C_{12}$–$C_{16}$ alkyl sulfates and alkylbenzene sulfonates, the $C_{12}$–$C_{16}$ ethoxylated (EO 0.5–10 avg.) alcohols, the $C_{12}$–$C_{14}$ N-methyl glucamides, and the like can be used herein, it is highly preferred to use surfactants which provide high grease/oil removal. Included among such preferred surfactants are the $C_{12}$–$C_{16}$ alkyl ethoxy sulfates (AES), especially in their magnesium salt form, and the $C_{12}$–$C_{16}$ dimethyl amine oxides. An especially preferred mixture comprises $MgAE_1S$/$MgAE_{6.5}S$/$C_{12}$ dimethyl amine oxide, at a weight ratio of about 1:1:1. If used, such surfactants will typically comprise from about 0.05% to about 2.5%, by weight, of the cleaning compositions herein.

In addition to the preferred solvents and emulsifiers disclosed above, the cleaning compositions herein may comprise various optional ingredients, such as perfumes, preservatives, co-solvents, brighteners, salts for viscosity control, pH adjusters and buffers, anti-static agents, softeners, colorants, mothproofing agents, insect repellents, and the like.

Container—The present cleaning process is conducted using a flexible container. The fabrics to be cleaned are placed within the container with the carrier/cleaning composition article, and the container is agitated, thereby providing contact between the carrier/cleaning composition and the surfaces of the fabrics.

The flexible container used herein can be provided in any number of configurations, and is conveniently in the form of a flexible pouch, or "bag", which has sufficient volume to contain the fabrics being cleaned. Suitable containers can be manufactured from any economical material, such as polyester, polypropylene, and the like, with the proviso that it must not melt if used in contact with hot dryer air. It is preferred that the walls of the container be substantially impermeable to water vapor and solvent vapor under the intended usage conditions. It is also preferred that such containers be provided with a sealing means which is sufficiently stable to remain closed during the cleaning process. Simple tie strings or wires, various snap closures such as ZIP LOK® closures, and VELCRO®-type closures, contact adhesives, adhesive tape, zipper-type closures, and the like, suffice.

The container can be of any convenient size, and should be sufficiently large to allow tumbling of the container and fabrics therein, but should not be so large as to interfere with the operation of the tumbling apparatus. With special regard to containers intended for use in hot air clothes dryers, the container must not be so large as to block the air vents. If desired, the container may be small enough to handle only a single shirt, blouse or sweater, or be sufficiently large to handle a man's suit.

Process—The present cleaning process can be conducted in any manner which provides mechanical agitation, such as a tumbling action, to the container with the fabrics being cleaned. If desired, the agitation may be provided manually. However, in a convenient mode a container with the carrier/cleaning composition and enveloping the soiled fabric is sealed and placed in the drum of an automatic clothes dryer. The drum is allowed to revolve, which imparts a tumbling action to the container and agitation of its contents concurrently with the tumbling. By virtue of this agitation, the fabrics come in contact with the carrier containing the cleaning composition. It is preferred that heat be employed during the process. Of course, heat can easily be provided in a clothes dryer. The tumbling and optional (but preferred) heating is carried out for a period of at least about 10 minutes, typically from about 20 minutes to about 30 minutes. The process can be conducted for longer or shorter periods, depending on such factors as the degree and type of soiling of the fabrics, the nature of the soils, the nature of the fabrics, the fabric load, the amount of heat applied, and the like, according to the needs of the user. The articles herein will typically be provided with from about 10 to about 25 grams of the cleaning compositions, but this can be varied according to soil loads on the fabrics, the size of the carrier sheets, and the like. The following illustrates a typical article and cleaning process in more detail, but is not intended to be limiting thereof.

EXAMPLE I

A dry cleaning article in sheet form is assembled using a sheet substrate and a cleaning composition prepared by admixing the following ingredients.

| Ingredient | % (wt.) |
|---|---|
| BPP* | 7.0 |
| 1,2-octanediol | 0.5 |
| PEMULEN TR-1** | 0.125 |
| KOH | 0.08 |
| Perfume | 0.75 |
| Water and minors*** | Balance |

*Isomer mixture, available from Dow Chemical Co.
**PEMULEN TR-2, B. F. Goodrich, may be substituted.
***Includes preservatives such as KATHON ®.

A non-linting carrier sheet is prepared using stock HYDRASPUN® Grade 10244 fabric, described above. The fabric is cut into square carrier sheets, approximately 9 in (22.9 cm)×10 in (25.4 cm), i.e., 580.6 $cm^2$ sheets.

23 Grams of the above-noted cleaning composition are evenly applied to the sheet by spreading onto the sheet with a roller or spatula using hand pressure. In an alternate mode, the cleaning composition can be applied by dipping or spraying the composition onto the substrate, followed by squeezing with a roller or pair of nip rollers, i.e., by "dip-squeezing" or "spray squeezing". The external surfaces of the sheet are damp but not tacky to the touch. The finished sheet can be folded for packaging, and when unfolded and used in the manner disclosed herein, the sheet remains in the desired unfolded configuration.

A dry cleaning sheet of the foregoing type is unfolded and placed flat in a plastic bag having a volume of about 25,000 $cm^3$ together with 2 kg of dry garments to be cleaned. The bag is closed, sealed and placed in a conventional hot-air clothes dryer. When the garments and the dry cleaning sheet are placed in the bag, the air is preferably not squeezed out of the bag before closing and sealing. This allows the bag to billow, thereby providing sufficient space for the fabrics and cleaning sheet to tumble freely together. The dryer is started and the bag is tumbled for a period of 20–30 minutes at a dryer air temperature in the range from about 50° C. to about 85° C. During this time, the dry cleaning sheet remains substantially in the desired open position, thereby providing effective contact with the fabrics. After the machine cycle is complete, the bag and its contents are removed from the dryer, and the spent dry cleaning sheet is discarried. The plastic bag is retained for re-use. The garments are refreshed and improved cleaning is secured. The water present in the cleaning composition serves to minimize wrinkles in the fabrics.

In an alternate mode, heavily soiled areas of the fabric being cleaned can optionally be pre-treated by pressing or rubbing a fresh dry cleaning sheet according to this invention on the area. The sheet and pre-treated fabric are then placed in the container, and the dry cleaning process is conducted in the manner described herein.

Having thus described and exemplified the present invention, the following further illustrates various cleaning compositions which can be formulated and used in the practice thereof.

| Ingredient | % (wt.) Formula Range |
|---|---|
| BPP* | 5–25% |
| 1,2-Octanediol | 0.1–7% |
| $MgAE_1S$ | 0.01–0.8% |
| $MgAE_{6.5}S$ | 0.01–0.8% |
| $C_{12}$ Dimethyl Amine Oxide | 0.01–0.8% |
| PEMULEN** | 0.05–0.20% |
| Perfume | 0.01–1.5% |
| Water | Balance |
| pH Range about 6 to about 8. | |

*Other organic cleaning solvents or co-solvents which can be used herein include various glycol ethers, including materials marketed under trademarks such as Carbitol, methyl Carbitol, butyl Carbitol, propyl Carbitol, and hexyl Cellosolve, methoxy propoxy propanol (MPP), ethoxy propoxy propanol (EPP), propoxy propoxy propanol (PPP), and all isomers and mixtures, respectively, of MPP, EPP, and PPP, and the like, and mixtures thereof. If desired, and having due regard for safety for in-home use, various conventional chlorinated and hydrocarbon dry cleaning solvents may also be used. Included among these are 1,2-dichloroethane, trichloroethylene, isoparaffins, and mixtures thereof. Although somewhat less preferred than BPP, the MPP, EPP and PPP etherified propanol solvents can be substituted in equivalent proportions for the BPP in the exemplified cleaning compositions for use in the present invention. Weight ratios of these latter solvents with the 1,2-octanediol are in the same range as disclosed for the preferred BPP solvent.
**As disclosed in U.S. Patents 4,758,641 and 5,004,557, such polyacrylates include homopolymers which may be crosslinked to varying degrees, as well as non-crosslinked. Preferred herein are homopolymers having a molecular weight in the range of from about 100,000 to about 10,000,000, preferably 200,000 to 5,000,000.

Excellent cleaning performance is secured using any of the foregoing non-immersion processes to provide an effective amount, i.e., typically from about 5 g to about 50 g of the cleaning compositions per kilogram of fabrics being cleaned.

EXAMPLE III

A dry cleaning kit comprises multiple (3–10) single-use sheets as disclosed in Example I and a multiple-use plastic bag. The sheets are folded for packaging. The folded sheets and folded plastic bag are placed in a carton or other package to provide a multi-use dry-cleaning kit.

EXAMPLE IV

A dry cleaning composition with reduced tendency to cause dye "bleeding" or removal from fabrics as disclosed above is as follows.

| INGREDIENT | PERCENT (wt.) | (RANGE) |
|---|---|---|
| Butoxypropoxy propanol (BPP) | 7.000 | 4.0–25.0% |
| NEODOL 23 - 6.5* | 0.750 | 0.05–2.5% |
| 1,2-Octanediol | 0.500 | 0.1–10.0% |
| Perfume | 0.750 | 0.1–2.0% |
| Pemulen TR-1 | 0.125 | 0.05–0.2% |
| Potassium Hydroxide (KOH) | 0.060 | 0.024–0.10 |
| Potassium Chloride | 0.075 | 0.02–0.20 |
| Water (distilled or deionized) | 90.740 | 60.0–95.0% |
| Target pH = 7.0 | | |

*Shell; $C_{12}$–$C_{13}$ alcohol, ethoxylated with average EO of 6.5.

15–25 Grams of a composition of the foregoing type are placed on a HYDRASPUN® carrier sheet for use in the manner disclosed herein. The sheet is placed together with the fabrics to be dry cleaned in a flexible containment bag having dimensions as noted hereinabove and sealing means. In a preferred mode, the containment bag is constructed of thermal resistant film in order to provide resistance to hot spots (350° F.–400° F.; 177° C. to 204° C.) which can develop in some dryers. This avoids internal self-sealing and external surface deformation of the bag, thereby allowing the bag to be re-used.

In a preferred embodiment, 0.0025 mm to 0.0075 mm thickness nylon film is converted into a 26 inch (66 cm)×30 in. (76 cm) bag. Bag manufacture can be accomplished in a conventional manner using standard impulse heating equipment, air blowing techniques, and the like. In an alternate mode, a sheet of nylon is simply folded in half and sealed along two of its edges.

In addition to thermally stable "nylon-only" bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer "shell" comprising a heat-resistant material such as nylon or polyethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400°–500° F. (204° C. to 260° C.). Nylon VELCRO®-type, ZIP-LOK®-type and/or zipper-type closures can be used to seal the bag, in-use.

Besides the optional nonionic surfactant components of the cleaning compositions used herein, which are preferably $C_8$–$C_{18}$ ethoxylated (E01–15) alcohols or the corresponding ethoxylated alkyl phenols, the compositions used herein can also contain enzymes to further enhance cleaning performance. Lipuses, amylases and protease enzymes, or mixtures thereof, can be used. If used, such enzymes will typically comprise from about 0.001% to about 5%, preferably from about 0.01% to about 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

If an antistatic benefit is desired, the compositions used herein can optionally contain an anti-static agent. If used, such anti-static agents will typically comprise at least about 0.5%, typically from about 2% to about 8%, by weight, of the compositions. Preferred anti-stats include the series of sulfonated polymers available as VERSAFLEX 157, 207, 1001, 2004 and 7000, from National Starch and Chemical Company.

The compositions herein can optionally be stabilized for storage using conventional preservatives such as KATHON® at a level of 0.001%–1%, by weight.

If the compositions herein are used in a spot-cleaning mode, they are preferably pressed (not rubbed) onto the fabric at the spotted area using an applicator pad comprising looped fibers, such as is available as APLIX 200 or 960 Uncut Loop, from Aplix, Inc., Charlotte, N.C. An underlying absorbent sheet or pad of looped fibers can optionally be placed beneath the fabric in this mode of operation.

What is claimed is:

1. A process for cleaning and refreshing fabrics, comprising contacting said fabrics with an article comprising:

a hydroentangled carrier substrate, said substrate releasably containing an aqueous cleaning composition (a) at least about 60%, by weight, of water;

(b) at least about 4%, by weight, of an etherified propanol solvent;

(c) 1,2-octanediol;

(d) optionally, a polyacrylate emulsifier;

(e) a detersive surfactant; and (f) optionally, a perfume.

2. A process according to claim 1 wherein the carrier substrate comprises a mixture of synthetic and natural fibers.

3. A process according to claim 1 wherein the carrier substrate is a sheet comprising a mixture of rayon, polyester, cellulosic and, optionally, bicomponent fibers.

4. A process according to claim 1 wherein the etherified propanol solvent is a member selected from the group consisting of methoxy-, ethoxy-, propoxy- and butoxypropoxypropanol, and mixtures thereof.

5. A process according to claim 4 wherein the cleaning composition comprises a mixture of butoxy propoxypropanol and 1,2-octanediol.

6. A process according to claim 1 wherein the surfactant is a member selected from the group consisting of amine oxides, alkyl ethoxy sulfates, ethoxylated alcohols, and mixtures thereof.

7. A process according to claim 1 which is conducted in a hot air clothes dryer, and wherein the process is conducted at an air temperature within said dryer of at least about 50° C.

8. A process according to claim 7 wherein the substrate is a hydroentangled sheet and wherein the hydroentangled sheet substrate and the fabrics are within a flexible containment bag.

* * * * *